US012384507B1

(12) United States Patent
Baer et al.

(10) Patent No.: US 12,384,507 B1
(45) Date of Patent: Aug. 12, 2025

(54) ELECTRIC MARINE PROPULSION SYSTEM AND CONTROL METHOD

(71) Applicant: Brunswick Corporation, Mettawa, IL (US)

(72) Inventors: Mitchell J. Baer, Fond Du Lac, WI (US); Jared D. Kalnins, Neenah, WI (US); Robert Raymond Osthelder, Omro, WI (US); Lukas G. Neveau, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 229 days.

(21) Appl. No.: 17/985,284

(22) Filed: Nov. 11, 2022

(51) Int. Cl.
*B63H 21/00* (2006.01)
*B63H 21/21* (2006.01)

(52) U.S. Cl.
CPC ..... *B63H 21/213* (2013.01); *B63H 2021/216* (2013.01)

(58) Field of Classification Search
None
See application file for complete search history.

(56) References Cited

U.S. PATENT DOCUMENTS 6,273,771 B1 8/2001 Buckley et al.
7,214,110 B1 5/2007 Ehlers et al.
8,762,022 B1 6/2014 Arbuckle et al.
9,555,869 B1 1/2017 Arbuckle et al.
9,957,028 B1 5/2018 O'Brien et al.
10,059,417 B1 8/2018 Hilbert et al.
10,155,577 B1 12/2018 Van Buren et al.
11,352,118 B1 * 6/2022 Dengel ..... B63H 21/213
11,628,920 B2 4/2023 Karnick et al.
11,691,605 B2 * 7/2023 Books ..... B60W 30/146 701/22
11,958,582 B1 * 4/2024 Yasnoff ..... B63H 21/20
2013/0344754 A1 * 12/2013 Kinoshita, I ..... F02D 41/021 440/1
2019/0092441 A1 * 3/2019 Biebach ..... B63H 20/10
2020/0062259 A1 * 2/2020 Huh ..... B60W 30/18072

OTHER PUBLICATIONS

Unpublished U.S. Appl. No. 17/985,284, filed Nov. 11, 2022 by Mitchell J. Baer.

* cited by examiner

*Primary Examiner* — James M McPherson
(74) *Attorney, Agent, or Firm* — Andrus Intellectual Property Law, LLP

(57) ABSTRACT

An electric marine propulsion system for a marine vessel is provided. The system includes a power storage system, an electric motor powered by the power storage system and configured to rotate a propulsor to propel the marine vessel, and a control system. The control system is configured to operate the electric motor according to an operator demand signal, determine whether at least one filter latch condition is satisfied, and responsive to a determination that the at least one filter latch condition is satisfied, operate the electric motor according to a filtered motor input.

16 Claims, 8 Drawing Sheets

FIG. 1
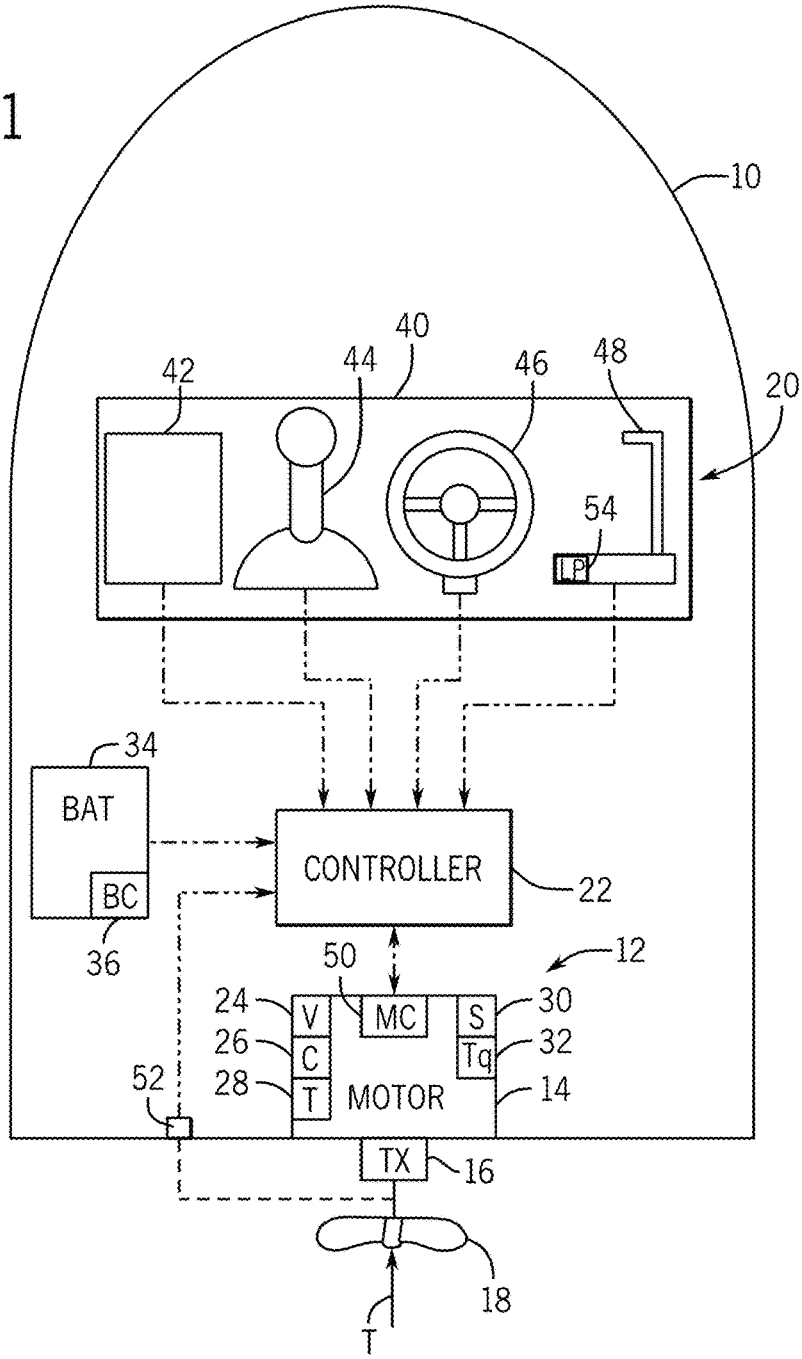
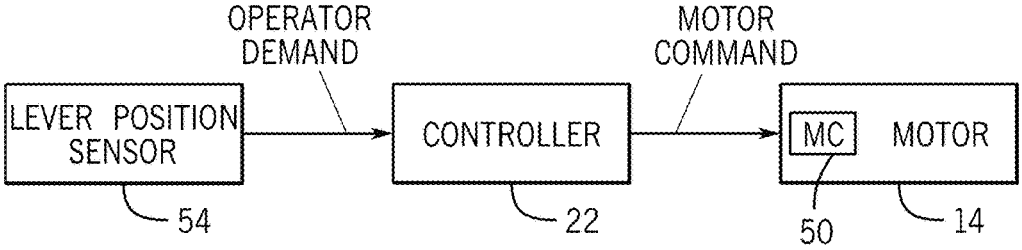
FIG. 2

ELECTRIC MARINE PROPULSION SYSTEM AND CONTROL METHOD

FIELD

The present disclosure generally relates to propulsion systems for marine vessels, and particularly to systems and methods for filtering input commands to an electric propulsion system in response to an operator demand indicating a panic shift or other quick demand change.

BACKGROUND

The following U.S. Patents and Patent Applications provide background information and are incorporated herein by reference, in entirety.

U.S. Pat. No. 6,273,771 discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,214,110 discloses an acceleration control system which allows the operator of a marine vessel to select an acceleration profile to control the engine speed of a marine vessel from an initial starting speed to a final desired speed. When used in conjunction with tow sports, such as wake boarding and water skiing, the use of acceleration profile provides consistent performance during the period of time when a water skier is accelerated from a stationary position to a full speed condition.

U.S. Pat. No. 8,762,022 discloses a system and method for efficiently changing controlled engine speed of a marine internal combustion engine in a marine propulsion system for propelling a marine vessel. The system responds to the operator changing the operator-selected engine speed, from a first-selected engine speed to a second-selected engine speed, by predicting throttle position needed to provide the second-selected engine speed, and providing a feed forward signal moving the throttle to the predicted throttle position, without waiting for a slower responding PID controller and/or overshoot thereof, and concomitant instability or oscillation, and then uses the engine speed control system including any PID controller to maintain engine speed at the second-selected engine speed.

U.S. Pat. No. 9,555,869 discloses a method for setting an engine speed of an internal combustion engine in a marine propulsion device of a marine propulsion system to an engine speed setpoint that includes determining the engine speed setpoint based on an operator demand and predicting a position of a throttle valve that is needed to achieve the engine speed setpoint. The method also includes determining a feed forward signal that will move the throttle valve to the predicted position, and after moving the throttle valve to the predicted position, adjusting the engine speed with a feedback controller so as to obtain the engine speed setpoint. An operating state of the marine propulsion system is also determined. Depending on the operating state, the method may include determining limits on an authority of the feedback controller to adjust the engine speed and/or determining whether the operator demand should be modified prior to determining the engine speed setpoint.

U.S. Pat. No. 9,957,028 discloses a method in which the speed of a marine propulsion system's engine is temporarily elevated in response to a decrease in helm demand. A controller receives a command to decrease the helm demand from a first helm demand to a second helm demand and compares a demand difference between the second helm demand and the first helm demand to a threshold demand delta. In response to the demand difference exceeding the threshold demand delta, the controller tabulates a time since the demand difference exceeded the threshold demand delta and determines an engine speed offset based upon the second helm demand and the time. The controller determines a non-elevated engine speed setpoint corresponding to the second helm demand and calculates an elevated engine speed setpoint based on the non-elevated engine speed setpoint and the engine speed offset. Engine speed is then decreased to the elevated engine speed setpoint.

U.S. Pat. No. 10,059,417 discloses a marine propulsion device that includes an internal combustion engine driving a driveshaft into rotation and a starter-generator motor in a torque transmitting relationship with the driveshaft. The starter-generator motor is alternately operable in a positive torque mode where it is powered by a battery to exert a positive torque on the driveshaft, and in a negative torque mode where it exerts a negative torque on the driveshaft and generates a charge to the battery. A control module is configured to receive an engine RPM, determine an engine RPM drop rate, and determine that the engine RPM drop rate exceeds a threshold drop rate. The starter-generator motor is then operated in a positive torque mode based on the engine RPM drop rate when the engine RPM drop rate exceeds the threshold drop rate.

U.S. Pat. No. 10,155,577 discloses a method for controlling a marine engine system includes receiving an operator demand to change an engine speed of the marine engine system, and then detecting a panic shift command based on the operator demand. A minimum speed demand value and hold period are then determined. A speed command to the marine engine system is set at or above the minimum speed demand value for at the least the hold period following detection of the panic shift command.

U.S. patent application Ser. No. 17/672,054 discloses an electric marine propulsion system for a marine vessel. The system includes a power storage system, an electric motor powered by the power storage system and configured to rotate a propulsor to propel the marine vessel, and a control system configured to operate the electric motor in a speed control mode to generate a variable propulsion output so as not to exceed a rated operation value and an open loop parameter control mode such that the electric motor is operated to exceed the rated operation value to generate a maximum propulsion output. The control system is further configured to receive an operator demand to accelerate the marine vessel; determine whether the operator demand exceeds a predetermined acceleration threshold; and operate the electric motor in the open loop parameter control mode to generate the maximum propulsion output.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, an electric marine propulsion system for a marine vessel is provided. The system includes a power storage system, an electric motor powered by the power storage system and configured to rotate a propulsor to propel the marine vessel, and a control system. The control system is configured to operate the electric motor according to an operator demand signal, determine whether at least one filter latch condition is satisfied, and responsive to a determination that the at least one filter latch condition is satisfied, operate the electric motor according to a filtered motor input.

In another embodiment, a method of controlling an electric marine propulsion system having an electric motor configured to rotate a propulsor to propel a marine vessel is provided. The method includes operating the electric motor according to an operator demand signal, determining whether at least one filter latch condition is satisfied, and responsive to a determination that the at least one filter latch condition is satisfied, operating the electric motor according to a filtered motor input.

Various other features, objects, and advantages of the invention will be made apparent from the following description taken together with the drawings.

BRIEF DESCRIPTION OF THE DRAWINGS

The present disclosure is described with reference to the following Figures.

FIG. 1 is a schematic top view representation of an exemplary marine vessel according to an implementation of the present disclosure.

FIG. 2 is a schematic representation of a control arrangement translating commands from a remote control to an electric marine propulsion system according to an implementation of the present disclosure.

DETAILED DESCRIPTION

Figure 3:
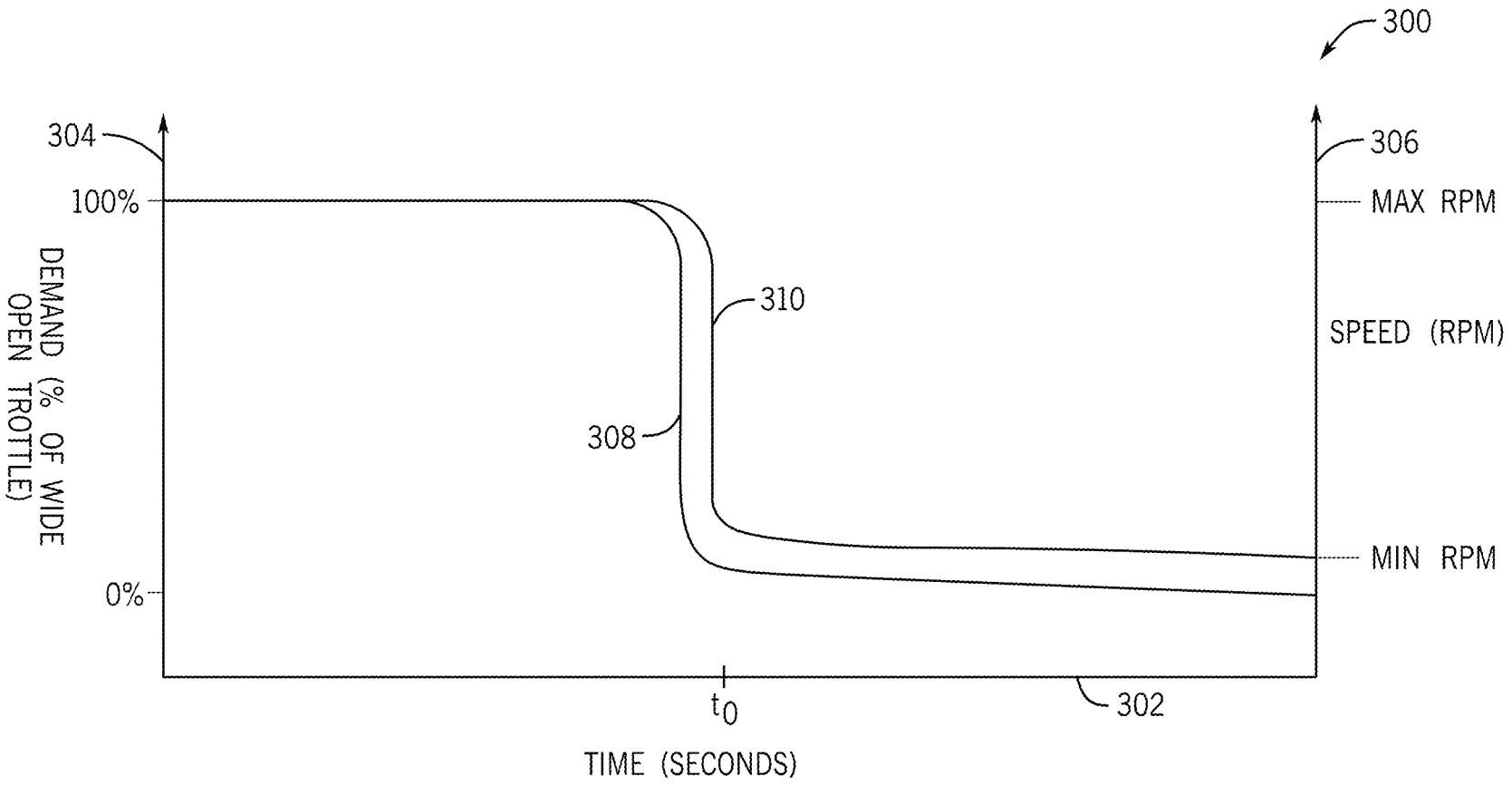
FIG. 3 is a plot depicting the correlation between operator demand and speed of the electric motor under nominal operating conditions.

The present inventors have recognized a need for systems and methods to minimize the risk of harm if an operator rapidly shifts a demand for a marine propulsion system from a high throttle demand value to a low throttle demand value. For example, an operator of a marine vessel travelling in a 100% wide open throttle position might spot an obstacle ahead of the vessel and immediately pull a throttle and shift lever back to a 0% throttle position in a panic. For marine propulsion systems incorporating internal combustion engines, such a change in throttle position did not pose a significant risk to the vessel or its occupants, because the physics inherent to internal combustion engines ensure that moving the throttle lever to a 0% throttle position does not instantaneously arrest rotation of the propulsor. However, when commanded to do so, electric motors can almost instantaneously cease rotation and can immediately switch direction of rotation, resulting in a very quick deceleration of the marine vessel, and potential harm to the vessel and its occupants. The present inventors have therefore recognized that systems and control methods configured to prevent such rapid decelerations of marine vessels incorporating electric propulsion systems would be useful.

FIG. 1 depicts an exemplary embodiment of a marine vessel 10 having an electric marine propulsion system 12 configured to propel the marine vessel 10 in a direction instructed by an operator using a user interface system 20, or by a guidance system configured to automatically control steering of the marine vessel 10 to steer the vessel toward a predetermined location or global position. The electric marine propulsion system 12 includes at least one electric motor 14 configured to propel the marine vessel 10 by rotating a propeller 18. The motor 14 may be, for example, a brushless electric motor, such as a brushless DC motor. In other embodiments, the electric motor 14 may be a DC brushed motor, an AC brushless motor, a direct drive, a permanent magnet synchronous motor, an induction motor, or any other device that converts electric power to rotational motion. In certain embodiments, the electric motor 14 includes a rotor and a stator, as is well known in the relevant art. The electric motor 14 is associated with a rated operation value that, in various embodiments, may refer to a rated current value or a rated torque value at which the motor 14 can maintain continuous operation without undue wear or damage. However, the present inventors have recognized that the motor 14 can operate at an operation value exceeding the rated operation value (e.g., an overcurrent value or an overtorque value) for short amounts of time to achieve maximum propulsion outputs exceeding those achievable at the rated operation value without substantial negative impacts to the motor 14.

The electric motor 14 is electrically connected to and powered by a power storage system or battery 34. The battery 34 stores energy for powering the electric motor 14 and is rechargeable, such as by connection to shore power when the electric motor 14 is not in use. Various power storage devices and systems are known in the relevant art. The battery 34 may be a battery system configured to output DC power including one or more banks of batteries. In other embodiments, the power storage device 34 may include one or more fuel cells, flow batteries, ultracapacitors, and/or other devices capable of storing an outputting electric energy. In further embodiments, an inverter configured to output AC power from a DC power input is associated with or otherwise a component of the power storage system 34.

The power storage device 34 may further include a battery controller 36 configured to monitor and/or control aspects of the power storage device 34. For example, the battery controller 36 may receive inputs from one or more sensors within the power storage system 34, such as a temperature sensor configured to sense a temperature within a housing of the power storage system 34 where one or more batteries or other storage elements are located. The battery controller 36 may further be configured to receive information from current, voltage, and/or other sensors within the power storage system 34, such as to receive information about the voltage, current, and temperature of each battery cell within the power storage device 34. In addition to the temperature of the power storage system 34, the battery controller 36 may be configured to calculate a charge level of the power storage system 34. The battery charge level may refer to a state of charge value, or some other value representing the amount of energy currently available from the power storage device 34.

The electric motor 14 is operably connected to the propeller 18 and configured to rotate the propulsor 18. As will be known to the ordinary skilled person in the relevant art, the propulsor 18 may include one or more propellers, impellers, or other propulsor devices and that the term "propeller" may be used to refer to all such devices. In certain embodiments, such as that represented in FIG. 1, the electric motor 14 may be connected and configured to rotate the propulsor 18 through a gear system or transmission 16. In such an embodiment, the gear system 16 translates rotation of a motor output shaft to a propeller shaft to adjust conversion of the rotation and/or to disconnect the propeller shaft from the drive shaft, as is sometimes referred to in the art as a "neutral" position where rotation of the drive shaft is not translated to the propeller shaft. Various gear systems or transmissions 16 are well known in the relevant art. In other embodiments, the electric motor 14 may directly connect to the propeller shaft such that rotation of the drive shaft is directly transmitted to the propeller shaft at a constant and fixed ratio.

Each electric motor 14 may be associated with a motor controller 50 that is configured to control power to the electric motor 14, such as to the stator winding thereof. The motor controller 50 is configured to control the function and output of the electric motor 14, such as controlling the torque outputted by the motor, the rotational speed of the motor 14, as well as the input current, voltage, and power supplied to and utilized by the motor 14. In one arrangement, the motor controller 50 controls the current delivered to the stator windings via leads which input electrical energy to the electric motor to induce and control rotation of the rotor.

Sensors may be configured to sense the power, including the current and voltage delivered to the motor 14. For example, a voltage sensor 24 may be configured to sense the input voltage to the motor 14 and a current sensor 26 may be configured to measure input current to the motor 14. Accordingly, power delivered to the motor 14 can be calculated and such value can be used for monitoring and controlling the electric propulsion system 12, including for monitoring and controlling the motor 14. In the depicted example, the voltage and current sensors 24, 26 may communicatively connected to the motor controller 50 in order to provide measurement of the voltage and current supplied to the motor 14. The motor controller 50 is configured to provide appropriate current and/or voltage to meet the demand for controlling the motor 14. For example, a demand input may be received at the motor controller 50 from the central controller 22, such as based on an operator command at a helm input device, such as a throttle lever 48. In certain embodiments, the motor controller 50, voltage sensor 24, and current sensor 26 may be integrated into a housing of the electric motor 14, although in other embodiments the motor controller 50 may be separately housed.

Various other sensors may be configured to measure and report parameters of the electric motor 14. For example, the electric motor 14 may include means for measuring and determining the torque, rotation speed (motor speed), temperature, vibration, or any other parameter. In the depicted example, the electric motor 14 includes a temperature sensor 28 to sense a temperature of the motor 14, a speed sensor 30 configured to measure a rotational speed of the motor 14, and a torque sensor 32 for measuring the torque output of the motor 14. A propeller speed sensor 52 may be configured to measure a rotational speed of the propeller 10. For example, the propeller speed sensor 52 and/or the motor speed sensor 30 may be a Hall Effect sensor or other rotation sensor that utilizes capacitive or inductive measuring techniques. In various implementations, one or more of the parameters, such as the speed, torque, or power, may be calculated based on other measured parameters or characteristics. For example, the torque exerted by the motor 14 may be calculated based on power characteristics in relation to the rotation speed of the electric motor 14, for example. In addition, the speed of the marine vessel 10 is directly proportional to the speed of the propeller 18 as measured by the propeller speed sensor 52, and therefore the speed of the marine vessel 10 may be calculated based on measurements obtained by the propeller speed sensor 52.

Each controller (i.e., a central controller 22, the battery controller 36, and the motor controller 50) in the control system may comprise a processor and a storage device, or memory, configured to store software and/or data utilized for controlling and/or tracking operation of the electric propulsion system 12. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output system (I/O) system provides communication between the control system including the central controller 22 and peripheral devices.

The central controller 22, which in the embodiment shown in FIG. 1 is a propulsion control module (PCM), communicates with the battery controller 36 and the motor controller 50 via a communication link such as a CAN bus as described in U.S. Pat. No. 6,273,771, incorporated by reference herein. The controller 22 also receives input from and/or communicates with one or more user interfaces in a user interface system 20 via the communication link, which in some implementations may be the same communication link as utilized for communication between the motor controller 50, battery controller 36, and central controller 22.

The user interface devices can include a display 42, a joystick 44, a steering wheel 46, and a throttle/shift lever 48. In various embodiments, the display 42 may be, for example, part of an onboard management system, such as the VesselView™ by Mercury Marine of Fond du Lac, Wisconsin. The joystick 44 and the steering wheel 46 may communicate with the central controller 22 to effectuate steering control over the propulsion system 12. For example, the joystick 44 may be utilized to provide lateral and rotational steering inputs to the propulsion system 12 during docking maneuvers. The control lever 48 is provided to permit an operator to input thrust commands, including both a magnitude and a direction of thrust. As is conventional, the control lever 48 is pivotally movable between a range of reverse positions between a reverse detent position (zero propulsor rotation) and a reverse wide open throttle position, a neutral position, and a range of forward positions between a forward detent position (zero propulsor rotation) and a forward wide open throttle position. A lever position sensor 54 may be placed anywhere on the control lever 48 in order to sense the position of the lever 48.

FIG. 2 schematically depicts an exemplary embodiment of a control arrangement having a controller 22 communicating commands to a motor 14. The user provides control inputs to the marine propulsion system 12 by moving the control lever 48 of the user interface system 20. The position of the control lever 48 is sensed by the lever position sensor 54. The position sensor 54 may be placed anywhere on the control lever 48 and/or the user interface system 20 in order to sense the rotational position of the control lever 48, which may vary between the reverse wide open throttle position and the forward wide open throttle position. The rotational position of the control lever 48 may be sensed at a predetermined interval by the position sensor 54 such that a rate of change of the position of the control lever 48 may be easily determined. The position sensor 54 may be an angular position sensor, and may provide an analog output or digital output of position to the controller 22. In various embodiments, the position sensor 54 may be a programmable magnetic encoder, a clinometer, a Hall Effect sensor, a potentiometer, a rotary encoder, or the like.

The lever position sensor 54 senses the rotational position of the control lever 48 and provides the rotational position as an operator demand to the controller 22. The operator demand may be a lever position or a motor parameter correlating thereto. For example, the operator demand may be a rotational position of the control lever 48 (such as a percentage of the maximum lever position in a particular direction), which may correlate to a demanded motor speed, motor torque, or motor current. Upon receipt of the operator demand, the controller 22 outputs a motor speed, torque, or current command value to the motor controller 50, which is the motor speed, torque, or current demanded based on the user input.

FIG. 3 is a plot depicting the correlation between operator demand (as indicated by line 308) and the speed (as indicated by line 310) of the electric motor 14 and/or the propulsor 18 under nominal (i.e., non-filtered motor input) operating conditions. The plot 300 is shown to include a horizontal axis 302 indicating time in seconds, a first vertical axis 304 indicating demand as a percentage of wide open throttle, and a second vertical axis 306 indicating speed in revolutions per minute (RPM). Prior to time to, the operator demands 100% wide open throttle in either the forward direction or the reverse direction, while at time to, the operator quickly reduces the commanded throttle or "panic shifts" the throttle to a 0% demand. Without the implementation of the control methods for filtering motor input described herein, the speed of the motor 14 indicated by line 310 is directly correlated with operator demand and is quickly reduced from a maximum RPM value to a minimum RPM value. Such a fast reduction in speed can be uncomfortable or dangerous to occupants of the marine vessel 10.

Figure 4:
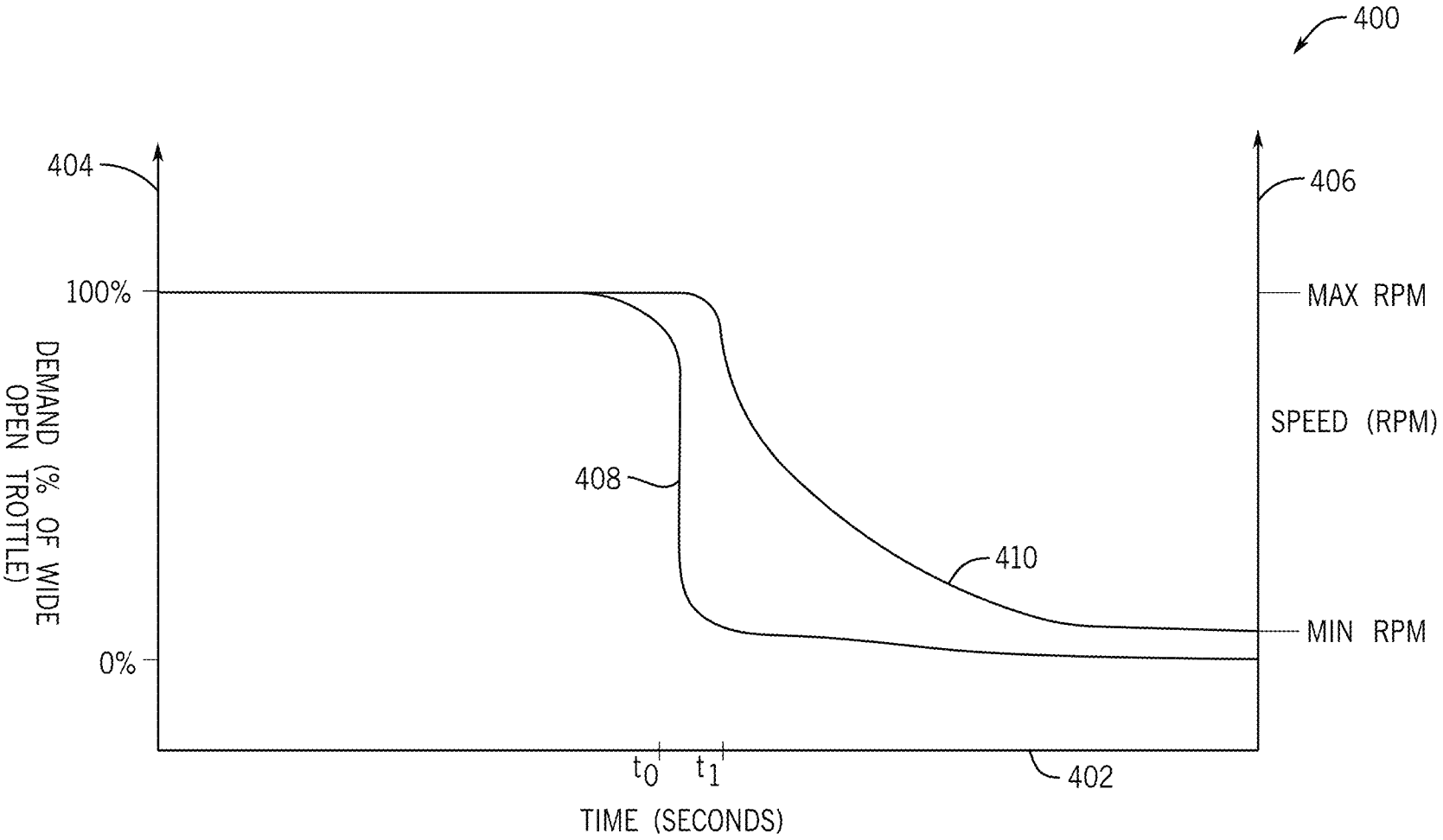
FIGS. 4 and 5 are plots depicting latching conditions that trigger implementation of a filtered motor input according to exemplary implementations of the present disclosure.

Turning now to FIG. 4, a plot 400 is shown depicting the correlation between operator demand (as indicated by line 408) and the speed (as indicated by line 410) of the electric motor 14 and/or the propulsor 18 when a filtered motor input is applied. Similar to plot 300, horizontal axis 402 indicates time in seconds, first vertical axis 404 indicates demand as a percentage of wide open throttle, and second vertical axis 406 indicates speed in RPM. However, when the operator panic shifts the throttle from 100% to 0% demand at time to, the controller 22 detects the satisfaction of a filter latch condition and applies a filter to the motor command supplied to motor controller 50 beginning at time $t_1$, such that the speed of the motor 14 and/or the propulsor 18 as shown by line 410 is smoothly and gradually reduced from a maximum RPM to a minimum RPM. In various embodiments, the minimum RPM may correspond to a minimum controllable RPM value (e.g., 50-100 RPM), although some electric motors are controllable to a minimum of 0 RPM. In an exemplary embodiment, the controller 22 is configured to apply a first order filter to the operator demand signal. However, the type of filtering is not particularly limited, and in other embodiments, a different type of filtering technique may be applied to the demand signal, for example, torque shaping, rate change limiting, linear filtering, step change operations, or the like.

Figure 5:
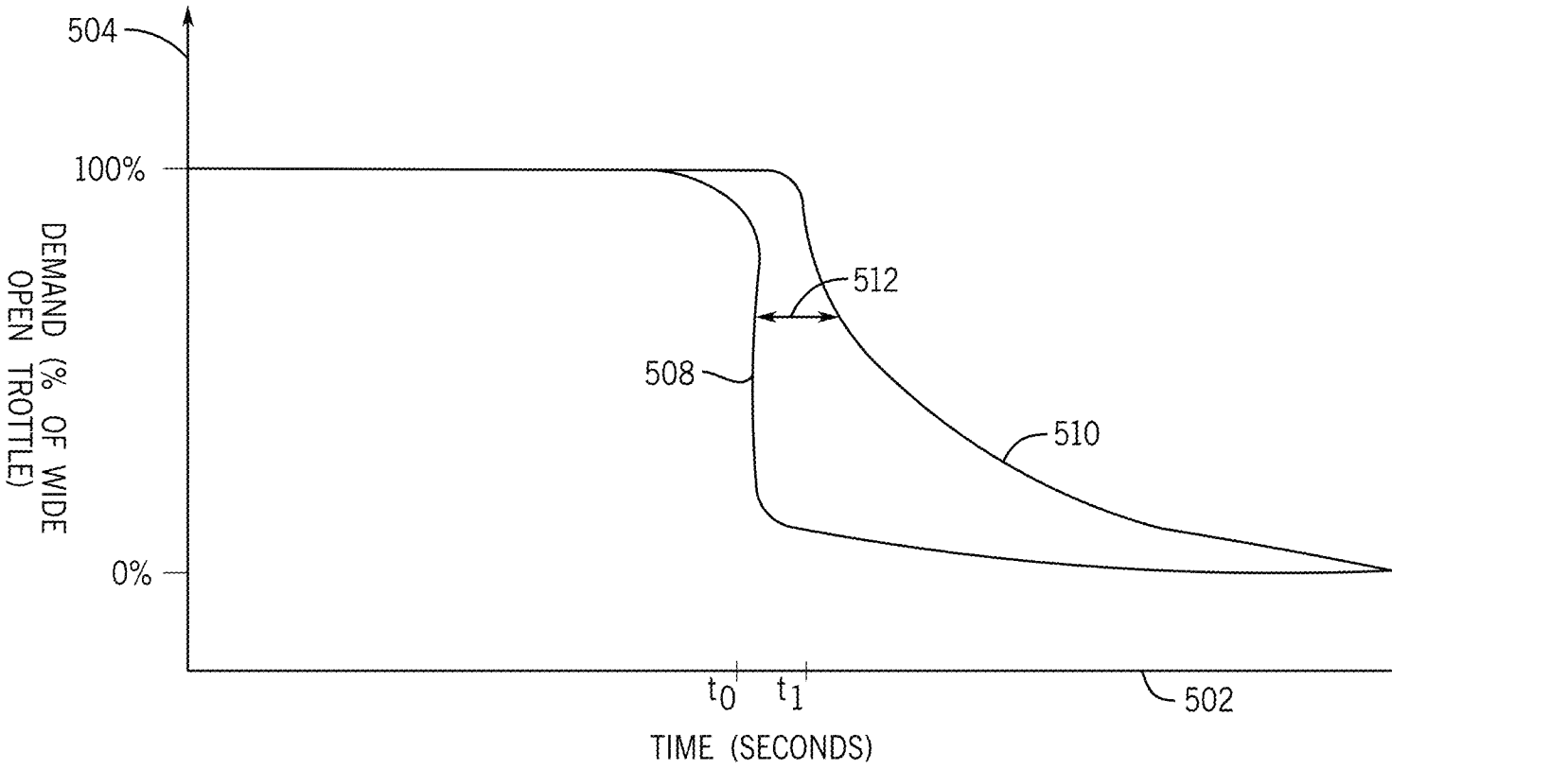

In some implementations, as depicted in FIG. 4, the satisfaction of the filter latch condition occurs when the reduction in operator demand is both determined to be greater than a reduction demand threshold and occurring in a time period that is less than a reduction time threshold. For example, a reduction in demand from 100% wide open throttle to 0% or 90% to 10% may not pose a risk if occurring over a period of several seconds, rather than a second or less. The thresholds may depend on the maximum power output of the motor 14. For example, on a 5 horsepower outboard motor, the reduction demand threshold may be a 10% reduction in demand and the reduction time threshold may be 25 milliseconds. In other words, the filter latch condition may be satisfied whenever an operator reduces the demand by more than 10% over a period of less than 25 milliseconds. Although the application of a filter to a motor input may occur when the marine vessel 10 is traveling in both the forward and reverse directions, in various embodiments, the thresholds for satisfaction of the filter latch may differ between the forward and the reverse directions, and the type or amount of filtering of the operator demand may differ. For example, a more aggressive filter may be applied to an operator demand when the marine vessel 10 is traveling in a forward direction, because the vessel is likely to be traveling faster than if the vessel were traveling in reverse, and accordingly, a fast reduction in the speed of the vessel could pose a risk to the occupants of the vessel. In yet another implementation, as depicted in FIG. 5, the satisfaction of the filter latch condition occurs when the difference in time value (as indicated by arrow 512) between an operator demand (as indicated by line 508) and a calculated first-order-filtered demand value (as indicated by line 510) exceeds a certain threshold.

As was described above, the purpose of satisfying a filter latch condition and applying a filter to the operator demand is to gradually, rather than suddenly, ramp out a motor input, thus resulting in a gradual and safe reduction in the speed of the marine vessel 10, in both the forward and reverse directions. However, the present inventors have recognized that application of such a filter to the operator demand is not desirable in perpetuity, as a filtered input may take an excessive amount of time to reach a desired zero motor speed. Accordingly, the control methods of the present invention include the following unlatching conditions (depicted and described herein with reference to FIGS. 6-8) to ensure that an unfiltered operator input controls the electric motor 14 when it is safe and/or otherwise desirable to so.

Figure 6:
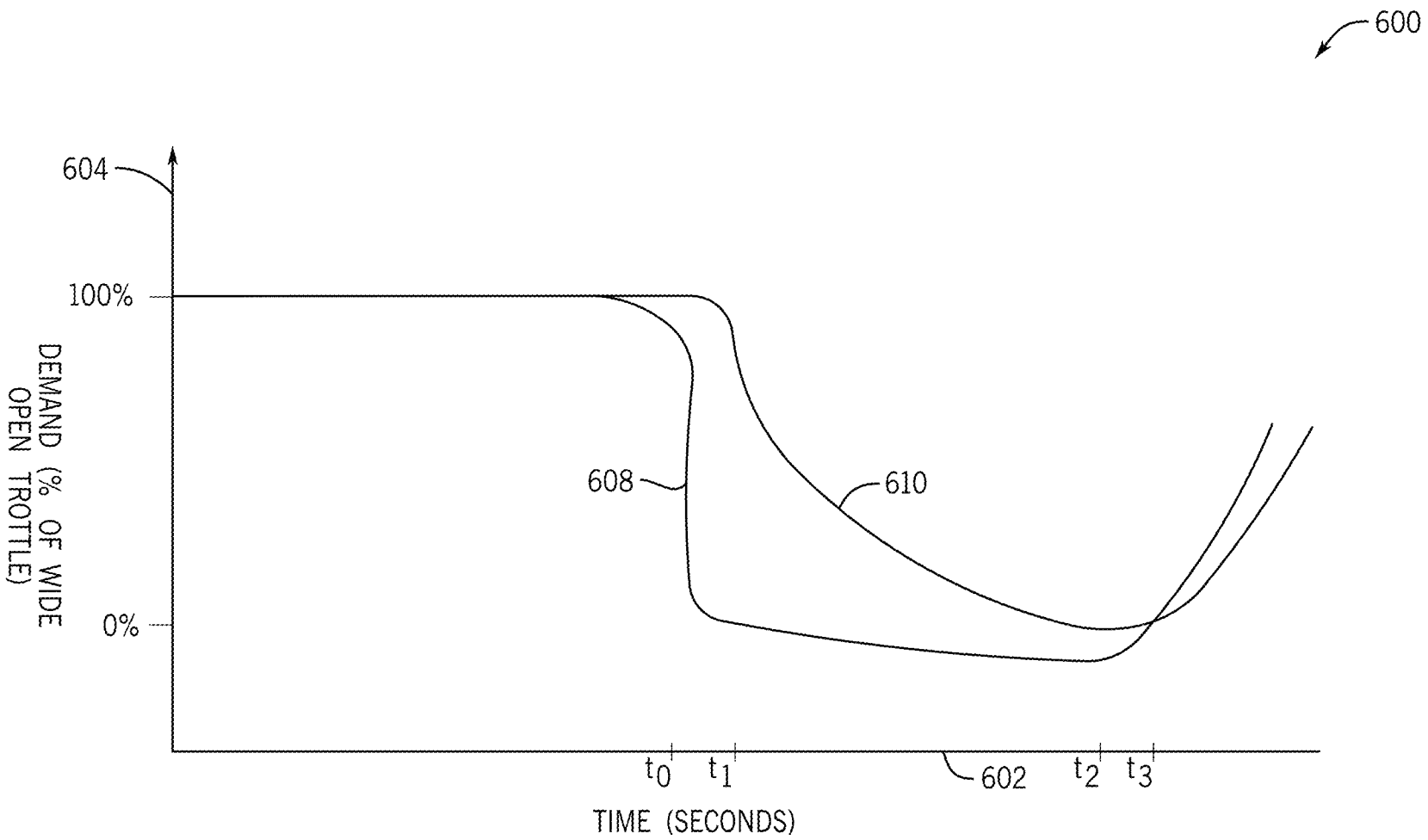
FIGS. 6-8 are plots depicting unlatching conditions that trigger a return to nominal operating conditions regarding operator demand according to exemplary implementations of the present disclosure.

FIG. 6 is a plot 600 depicting one instance in which an unlatching condition is satisfied, and nominal operation according to the operator demand input (as represented by line 608) is resumed. As described above with reference to FIG. 4, prior to time to, the operator demand is at 100% of wide open throttle, and the motor input demand (as represented by line 610) is likewise at 100%. Between time to and time $t_1$, the latch condition is satisfied, and the controller applied a filter to the motor input demand. This filtering of the motor input demand continues through time $t_2$, at which point the operator demand indicated by line 608 begins to increase, and at time $t_3$, intersects the filtered demand indicated by line 610. In other words, an absolute value of the operator demand becomes greater than or equal to the filtered demand. Once the intersection of the operator demand and filtered demand occurs, the controller 22 unlatches the filtered demand, and resumes operation of the electric motor 14 per the unfiltered operator demand 608.

Figure 7:
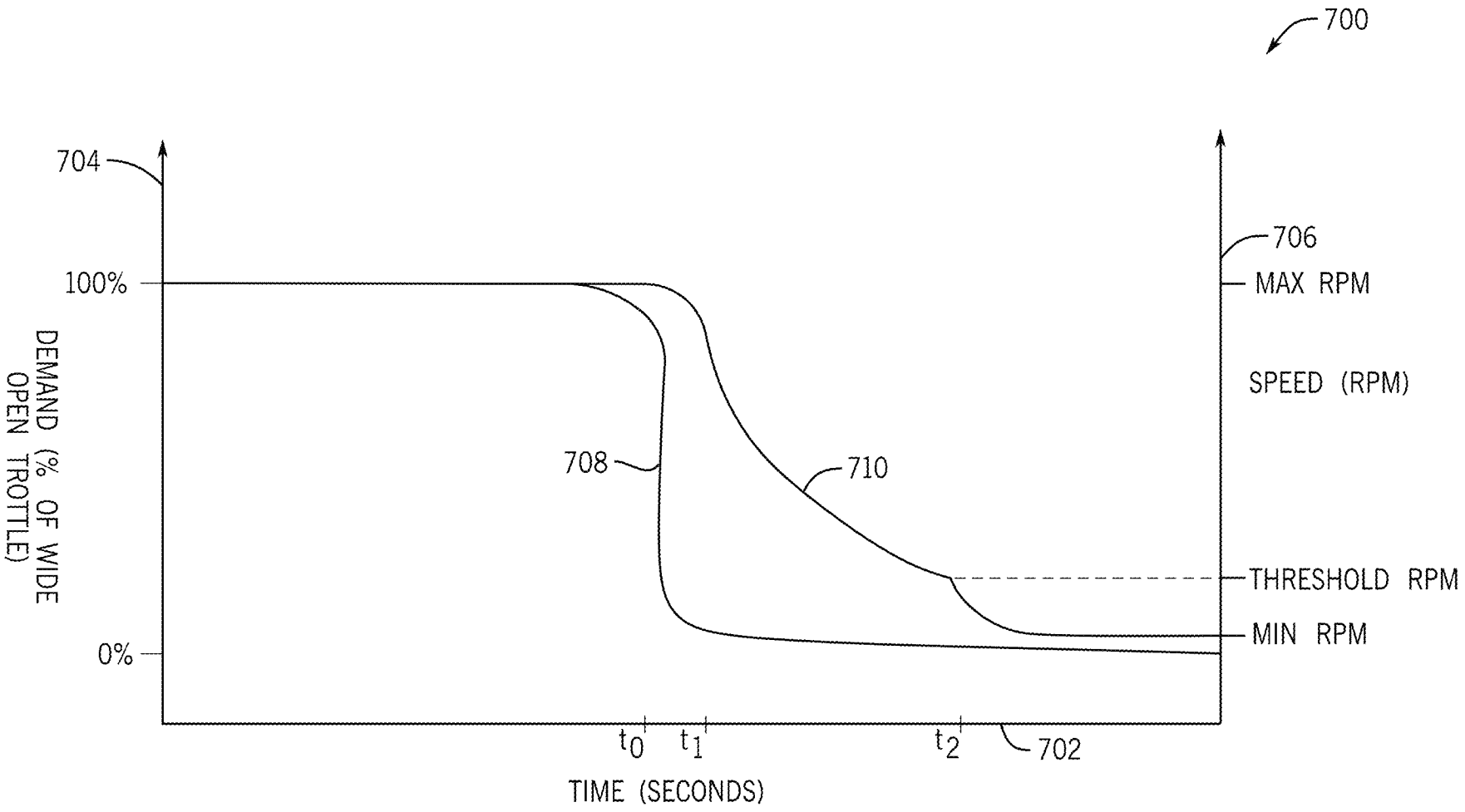
Figure 8:
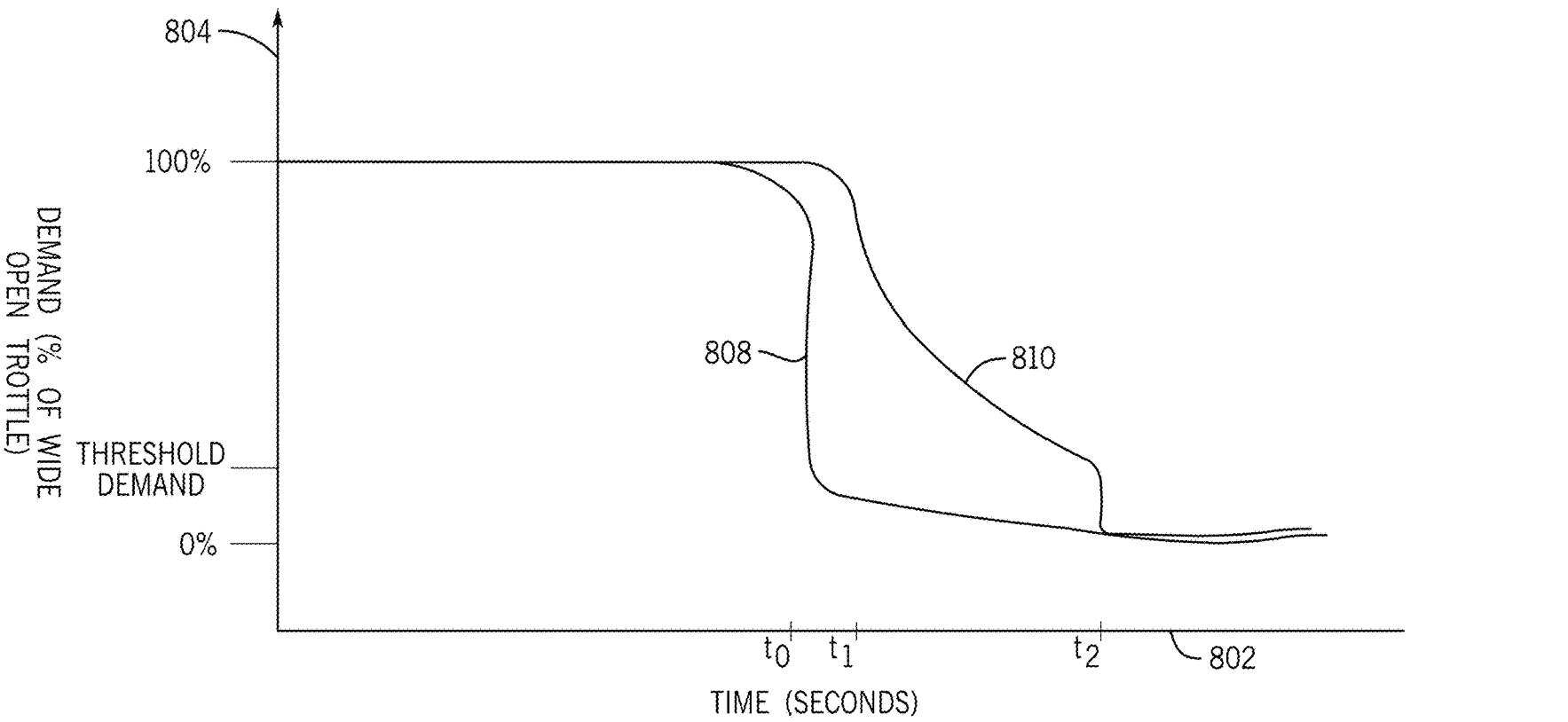

FIGS. 7 and 8 depict additional implementations of the satisfaction of unlatching conditions through the use of minimum speed and demand thresholds. As shown in plot 700, the filtering of a commanded speed (indicated by line 710) occurs beginning at time $t_1$. At time $t_2$, the filtered speed drops below a threshold minimum RPM, the unlatching condition is satisfied, and the controller 22 resumes operating the electric motor 14 per the operator demand indicated by line 708. Similarly, as shown in plot 800, the filtering of a demand signal (indicated by line 810) occurs beginning at time $t_1$. At time $t_2$, the filtered demand drops below a threshold minimum demand value, the unlatching condition is satisfied, and the controller 22 resumes operating the electric motor 14 per the operator demand indicated by line 808. In various embodiments, multiple unlatching conditions must be satisfied before the controller 22 resumes operating the electric motor 14 per the operator demand indicated by lines 708 and 808. For example, the controller 22 may not stop operating the motor 14 per a filtered input until both the speed of the motor and the filtered demand signal are below the threshold values depicted in FIGS. 7 and 8.

Figure 9:
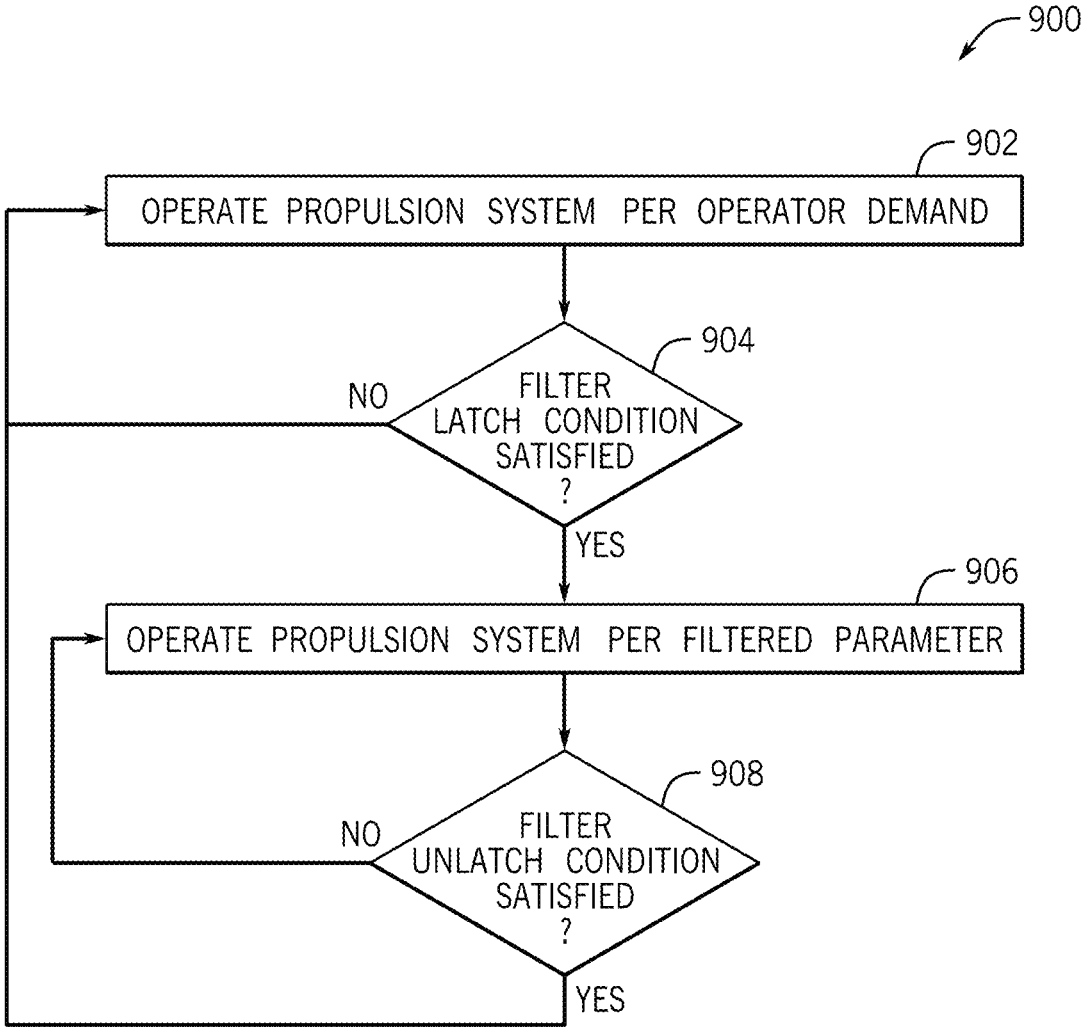
FIG. 9 is a flow chart illustrating an exemplary control method for operating an electric marine propulsion system according to an exemplary implementation of the present disclosure.

Turning now to FIG. 9, one embodiment of a method 900 of controlling an electric marine propulsion system 12 according to the present invention is depicted. In an exemplary implementation, method 900 is performed primarily by the central controller 22 and the motor controller 50, among other components. At step 902, the central controller 22 operates the propulsion system 12 according to the operator demand signal, for example, as provided by the lever position sensor 54. At step 904, the central controller 22 determines whether a filter latch condition has been satisfied. As depicted and described above, the filter latch condition may be satisfied in one instance when the commanded reduction in throttle is both greater than a reduction demand threshold, and when such commanded reduction does not exceed a reduction time threshold. In another instance, the filter latch condition is satisfied when the difference between a commanded demand value and a hypothetical filtered value exceeds a threshold.

If the central controller 22 determines that the operator demand signal does not satisfy a filter latch condition at step 904, method 900 reverts to step 902, and the motor 14 continues to be operated per the operator demand signal. If, however, the latch condition is satisfied at step 904, method 900 proceeds to step 906, and the controller 22 operates the motor 14 per a filtered motor input parameter. As described above, the filtered motor input parameter could be a percentage demand, a speed parameter, a torque parameter, or a current parameter, and could be based on an application of a first order filter or another type of filter to the operator demand signal.

At step 908, the central controller 22 determines whether a filter unlatch condition has been satisfied. As described above, the filter unlatch condition may be satisfied based on a determination that the filtered demand parameter has intersected with the operator demand signal (as depicted in FIG. 6), or that at least one of the filtered motor input parameters (speed, torque, current, demand) has dropped below a threshold value (see FIGS. 7 and 8). If the filter unlatch condition has not been satisfied, method 900 reverts to step 906 until the unlatch condition has been satisfied. Once satisfied, method 900 concludes as the process reverts to step 902 and motor 14 is again operated according to the unfiltered operator demand signal.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. An electric marine propulsion system for a marine vessel, comprising:

a power storage system;

an electric motor powered by the power storage system and configured to rotate a propulsor to propel the marine vessel; and a control system configured to:

operate the electric motor according to an operator demand signal;

determine whether at least one filter latch condition is satisfied based on the operator demand signal; and responsive to a determination that the at least one filter latch condition is satisfied, operate the electric motor according to a filtered motor input;

wherein the at least one filter latch condition comprises a change in the operator demand signal that exceeds a reduction demand threshold and does not exceed a reduction time threshold or a difference between the operator demand signal and a filtered demand signal exceeding a difference threshold.

2. The system of claim 1, wherein the control system is further configured to:

determine whether at least one filter unlatch condition is satisfied; and responsive to a determination that the at least one filter unlatch condition is satisfied, return operation of the electric motor according to the operator demand signal.

3. The system of claim 2, wherein the at least one filter unlatch condition comprises the operator demand signal intersecting with the filtered motor input.

4. The system of claim 2, wherein the at least one filter unlatch condition comprises a magnitude of the filtered motor input becoming less than a threshold value.

5. The system of claim 2, wherein the at least one filter unlatch condition comprises a speed of the electric motor or the propulsor becoming less than a threshold speed value.

6. The system of claim 2, wherein the at least one filter unlatch condition comprises both a magnitude of the filtered motor input becoming less than a threshold value and a speed of the electric motor or the propulsor becoming less than a threshold speed value.

7. The system of claim 1, wherein the operator demand signal is based on a position of a control lever.

8. The system of claim 1, wherein operating the electric motor according to a filtered motor input comprises applying a first order filter to the operator demand signal.

9. A method of controlling an electric marine propulsion system having an electric motor configured to rotate a propulsor to propel a marine vessel, the method comprising:

operating the electric motor according to an operator demand signal;

determining whether at least one filter latch condition is satisfied based on the operator demand signal; and responsive to a determination that the at least one filter latch condition is satisfied, operating the electric motor according to a filtered motor input;

wherein the at least one filter latch condition comprises a change in the operator demand signal that exceeds a reduction demand threshold and does not exceed a reduction time threshold or a difference between the operator demand signal and a filtered demand signal exceeding a difference threshold.

10. The method of claim 9, further comprising:

determining whether at least one filter unlatch condition is satisfied; and responsive to a determination that the at least one filter unlatch condition is satisfied, returning operation of the electric motor according to the operator demand signal.

11. The method of claim 10, wherein the at least one filter unlatch condition comprises the operator demand signal intersecting with the filtered motor input.

12. The method of claim 10, wherein the at least one filter unlatch condition comprises a magnitude of the filtered motor input becoming less than a threshold value.

13. The method of claim 10, wherein the at least one filter unlatch condition comprises a speed of the electric motor or the propulsor becoming less than a threshold speed value.

14. The method of claim 10, wherein the at least one filter unlatch condition comprises both a magnitude of the filtered motor input becoming less than a threshold value and a speed of the electric motor or the propulsor becoming less than a threshold speed value.

15. The method of claim 9, wherein the operator demand signal is based on a position of a control lever.

16. The method of claim 9, wherein operating the electric motor according to a filtered motor input comprises applying a first order filter to the operator demand signal.

* * * * *